United States Patent [19]

Hutcheson

[11] Patent Number: 4,580,384

[45] Date of Patent: Apr. 8, 1986

[54] ROOF PANEL MATERIAL

[75] Inventor: Kelvin B. Hutcheson, Sydney, Australia

[73] Assignee: Hunter Douglas International N.V., Curacao, Netherlands Antilles

[21] Appl. No.: 520,511

[22] Filed: Aug. 4, 1983

[51] Int. Cl.[4] ..... E04D 1/00

[52] U.S. Cl. ..... 52/537; 52/519; 52/528; 52/630; 52/748

[58] Field of Search ..... 52/537, 544, 545, 748, 52/630, 671, 478, 520, 522, 530, 528, 547, 536, 518, 519; 405/276

[56] References Cited

U.S. PATENT DOCUMENTS

| | | | |
|---|---|---|---|
| 1,039,401 | 9/1912 | Hoffman | 52/537 |
| 2,968,931 | 1/1961 | McGrath | 405/276 |
| 4,223,503 | 9/1980 | Hague | 52/522 |
| 4,224,775 | 9/1980 | Heckelsberg | 52/630 |

FOREIGN PATENT DOCUMENTS

| | | | |
|---|---|---|---|
| 128057 | 6/1946 | Australia | 52/544 |
| 1602597 | 11/1981 | United Kingdom | 405/276 |

*Primary Examiner*—Donald G. Kelly
*Assistant Examiner*—Richard E. Chilcot, Jr.
*Attorney, Agent, or Firm*—Pennie & Edmonds

[57] ABSTRACT

A corrugated sheet roof panel has one longitudinal edge formation and one marginal strip of the panel which has a width less than the pitch distance between adjacent corrugations where the edge formation includes a female receptive bead. The opposite longitudinal edge formation of the panel includes a second marginal strip of the panel where the formation includes an inverted U-shaped male bead. The male bead of one panel is adapted to be snapped into the female bead of an adjacent panel to lock adjacent panels together.

5 Claims, 2 Drawing Figures

ROOF PANEL MATERIAL

TECHNICAL FIELD

This invention relates to panel materials for roofs of the kind comprising a plurality of corrugated sheet metal or plastics panels or strips which are laid side-by-side on a supporting structure so that the lengths of the strips and the corrugations thereof, extend (usually) in the Water-shedding direction of the roof; that is, in the direction which runs, in an ordinary pitched roof, from ridge to eave. More particularly, the invention is concerned with such panels which are used for what may be called light-weight roofs for patios, awnings, carports and like structures in which the panels while being lightweight in themselves are required to be self-supporting over relatively large spans (for the full ridge to eave distance, for example) without the benefit of an array of purlins, supported by rafters or the like, as is common with more substantial roofs such as those for dwellings, factories and the like.

BACKGROUND ART

Panels of the class to which those of this invention belong, are frequently made of aluminium for light weight, and they are distinguishable from the corrugated sheets used in the more substantial sense indicated above, in that the width of the present panels is small relative to the length, and the pitch and general dimensions of the corrugations are very large; to a degree, for example, such that across its full width a sheet will usually have no more than two complete corrugations.

Panels of the kind in question have longitudinal edge formations whereby each panel in an array thereof is joined to its neighbouring panel or immediately adjacent, and hitherto the panels have proved quite satisfactory except when called upon to withstand loadings beyond those involved purely in the roofage function; for example, when a person imposes his weight on the roof.

Under such abnormal loadings, the prior panels deflect and tend to come apart at the joints. It will also be appreciated that in all roofing arrangements composed of corrugated sheets or panels, edge joining is accompanied by some degree of overlap of sheet edge margins. In the more commonly employed sheets, this overlap is achieved, without substantial impairment of even, uniform corrugation appearance, by overlapping the sheets by at least one whole corrugation; whereas, with panels such as those subject hereof, whole corrugation overlap is economically out of the question since, owing to the large size and the fewness of the corrugations, it would amount to making a twin layer roof, or at least one in which a majority of the roofed area would be of double-layer sheet material.

The object of this invention is to improve the situation indicated by the provision of roof panels in which overlap is confined to an extremely small amount of the roofed area, without substantial impairment of the roof underside appearance of corrugation eveness or continuity; and this, in a lightweight manner while being virtually proof against lap-joint separation under abnormal loadings.

DISCLOSURE OF INVENTION

The invention provides a corrugated sheet roof panel having:

(a) one longitudinal edge formation consisting of a first marginal strip which is fractional in width by comparison with the pitch of the panel's corrugations, and conforms with the corrugation profile of the panel;

a female receptive bead disposed wholly outside said profile and along the distal edge of said first strip, and a stepped flange which forms part of said bead, extends along the distal edge thereof and is directed towards said profile, and, (b) a second longitudinal edge formation consisting of an opposite second marginal strip which is fractional in width by comparison with said pitch and conforms with said profile; and, an inverted U-shaped male bead having a distal limb disposed wholly outside said profile and along the distal edge of said opposite strip, the arrangement being such that said male bead can easily enter the female bead of a neighbouring or contiguous similar panel but is less easily withdrawable therefrom due to the distal limb of said male bead abutting firmly against the stepped flange of said neighbouring panel when said male bead is entered into said female bead and said strips are substantially co-planar.

BRIEF DESCRIPTION ON THE DRAWINGS

BEST MODE FOR CARRYING OUT THE INVENTION

Figure 1:
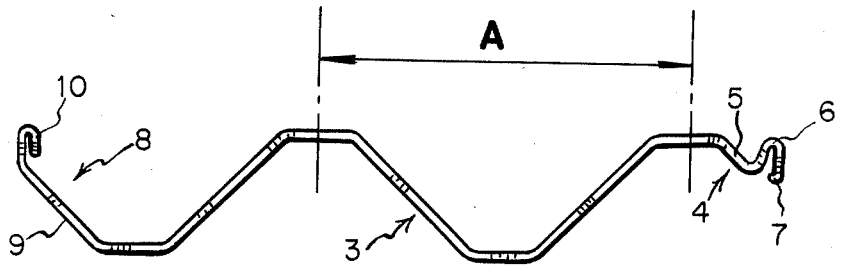
FIG. 1 is an end elevation of a panel.

Referring to the drawings, panel 3 has almost two complete corrugations, one being indicated by pitch span "A". The panel has a longitudinal edge formation 4 consisting of a first marginal strip 5 which is fractional in width by comparison with pitch "A", and is trended in conformity with the general corrugation profile of the panel; and a female receptive bead 6 disposed wholly outside the corrugation profile and along the distal edge of strip 5. Bead 6 includes a stepped flange 7 which extends along the distal edge of the bead and is directed towards the corrugation profile.

The opposite longitudinal edge of the panel carries a second longitudinal edge formation 8 consisting of an opposite second marginal strip 9 which is fractional in width by comparison with span "A" and is trended in conformity with said profile. This opposite strip carries an inverted U-shaped male bead 10. Bead 10 is able easily to enter bead 6 but is virtually proof against withdrawal therefrom, when strip 9 is virtually co-planar with strip 5 owing to the distal limb of bead 10 then being obstructed by flange 7 as shown in FIG. 2.

As it will be apparent to those skilled in the art the panels of this invention may be assembled together by simply snapping one marginal strip into the other thereby avoiding having to slide one longitudinally into the other. Thus the immediately adjacent panels are locked together at their respective marginal edges by snapping bead 10 into bead 6. Disengagement can only occur when one panel is raised at its disengaged longitudinal edge having a female receptive bead 6 thereon. This causes the strip 9 to turn about stepped flange 7 releasing bead 10.

Figure 2:
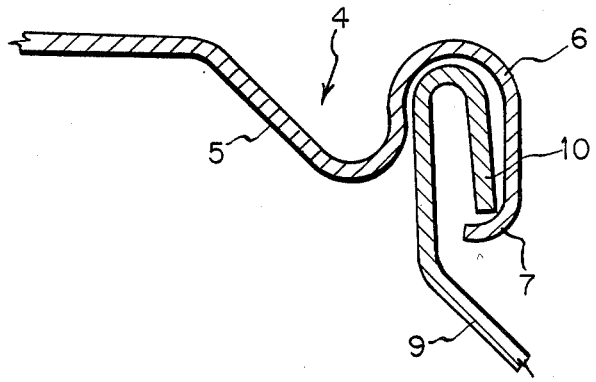
FIG. 2 is a sectioned view, on a considerably enlarged scale, showing the male bead of one panel homed in the female bead of a similar panel.

As shown in FIG. 2, the top of the female receptive bead 6 and the inverted U-shaped male bead 10 are below, or at the most, level with the tops of the corrugation profile.

Further as shown in FIG. 1, a first marginal strip 5 connecting with the top of a corrugation of one panel and a second marginal strip 9 connecting with a bottom of a corrugation of an adjacent panel conform with corrugation profile of a panel joining a top of a corrugation with a bottom of a corrugation.

In accordance with the existing art the longitudinal edges can be formed simultaneously with the corrugations when the sheets are rolled. Alternatively, the longitudinal edges can be simultaneously extruded as the sheets are formed. Although the longitudinal edges are shown as being formed of the same thickness as the corrugations they can be made thicker to give increased rigidity to the perspective beads to ensure against separation when a load is imposed on a sheet.

I claim:

1. A corrugated sheet roof panel comprising:

one longitudinal edge formation consisting of a first marginal strip which is fractional in width by comparison with the pitch of the panel's corrugation and conforms with the corrugation profile of the panel, a female receptive bead disposed wholly outside and above said profile and along the distal edge of said first marginal strip, opening in a direction facing the bottom of the corrugation, and a stepped flange forming part of said bead extending along the distal edge thereof and directed towards said profile, and a second longitudinal edge formation consisting of an opposite second marginal strip which is fractional in width by comparison with said pitch and conforms with said profile, and, an inverted U-shaped male bead having a distal limb disposed wholly outside said profile and along the distal edge of said second marginal strip, whereby said male bead can easily enter the female bead of a contiguous similar panel by moving said panel and similar panel in a direction perpendicular to the distal edge, but is not easily withdrawable therefrom due to the distal limb of said male bead abutting firmly against the stepped flange of said female bead of a contiguous similar panel when said marginal strips are substantially co-planar, and wherein the top of said female receptive bead and said inverted U-shaped male bead are below or at the most level with a plane passing through the tops of the corrugation profile.

2. A corrugated sheet roof panel comprising:

one longitudinal edge formation consisting of a first marginal strip which is fractional in width by comparison with the pitch of the panel's corrugation and conforms with the corrugation profile of the panel, a female receptive bead disposed wholly outside said profile and along the distal edge of said first marginal strip, and a stepped flange forming part of said bead extending along the distal edge thereof and directed towards said profile, and a second longitudinal edge formation consisting of an opposite second marginal strip which is fractional in width by comparison with said pitch and conforms with said profile, and, an inverted U-shaped male bead having a distal limb disposed wholly outside said profile and along the distal edge of said second marginal strip, whereby said male bead can easily enter the female bead of a contiguous similar panel but is not easily withdrawable therefrom due to the distal limb of said male bead abutting firmly against the stepped flange of said female bead of a contiguous similar panel when said marginal strips are substantially co-planar, and wherein the top of said female receptive bead and said inverted U-shaped male bead are below or at the most level with a plane passing through the tops of the corrugation profile.

3. A corrugated sheet roof panel as defined in claim 1 wherein said longitudinal edge formations are formed with a greater thickness of material than the corrugated portions of said sheet roof panel.

4. A corrugated sheet roof panel as defined in claim 1 wherein said male bead is adapted to snap into place in said female bead of a contiguous panel as contiguous panels are moved towards each other and when the distal limb of the male bead moves past the stepped flange of the female bead.

5. A corrugated sheet roof panel as defined in claim 1 wherein said first marginal strip connects with the top of a corrugation and said second marginal strip connects with the bottom of a corrugation whereby a first strip of one panel together with the second strip of a contiguous panel conform with the corrugation profile of a panel joining a top of a corrugation with a bottom of a corrugation.

* * * * *